US011303036B2

(12) United States Patent
Xin et al.

(10) Patent No.: US 11,303,036 B2
(45) Date of Patent: Apr. 12, 2022

(54) HOLLOW LIGHT WEIGHT LENS STRUCTURE

(71) Applicant: Arizona Board of Regents on Behalf of The University of Arizona, Tucson, AZ (US)

(72) Inventors: Hao Xin, Tucson, AZ (US); Min Liang, Tucson, AZ (US)

(73) Assignee: Arizona Board of Regents on Behalf of The University of Arizona, Tucson, AZ (US)

( * ) Notice: Subject to any disclaimer, the term of this patent is extended or adjusted under 35 U.S.C. 154(b) by 0 days.

(21) Appl. No.: 16/622,811

(22) PCT Filed: Jun. 15, 2018

(86) PCT No.: PCT/US2018/037885
§ 371 (c)(1),
(2) Date: Dec. 13, 2019

(87) PCT Pub. No.: WO2018/232325
PCT Pub. Date: Dec. 20, 2018

(65) Prior Publication Data

US 2021/0151894 A1 May 20, 2021

Related U.S. Application Data

(60) Provisional application No. 62/521,098, filed on Jun. 16, 2017.

(51) Int. Cl.
*H01Q 15/10* (2006.01)

(52) U.S. Cl.
CPC ..... *H01Q 15/10* (2013.01)

(58) Field of Classification Search
CPC ..... H01Q 15/02; H01Q 15/08; H01Q 15/10
See application file for complete search history.

(56) References Cited

U.S. PATENT DOCUMENTS 3,254,345 A 5/1966 Hannan
3,293,649 A * 12/1966 Fox ..... H01Q 15/08 343/911 R (Continued)

FOREIGN PATENT DOCUMENTS

CN 103995304 A 8/2014

OTHER PUBLICATIONS

Office Action dated May 19, 2021 for Chinese Patent Application No. 201880052898.3.

(Continued)

*Primary Examiner* — Jason Crawford
(74) *Attorney, Agent, or Firm* — Mintz Levin Cohn Ferris Glovsky and Popeo, P.C.

(57) ABSTRACT

A hollow light-weight, low-cost, and high-performance 3D Luneburg lens structure using partially-metalized thin film, string, threads, fiber or wire base metamaterial to implement the continuously varying relative permittivity profile, characteristic of Luneburg lens structures, is disclosed. The hollow light-weight lens structure is based on the effective medium approach and may be implemented by a number of means. Further, most of the volume of the lens structure is free-space, thus the weight of the lens is significantly less than conventional 3D Luneburg lens structures of the same dimensions.

13 Claims, 19 Drawing Sheets

(56) References Cited

U.S. PATENT DOCUMENTS

| | | | | |
|---|---|---|---|---|
| 3,430,248 | A | 2/1969 | Lightbowne | |
| 5,421,848 | A | 6/1995 | Maier et al. | |
| 6,549,340 | B1 * | 4/2003 | Hirtzlin | H01Q 15/08 359/652 |
| 9,772,476 | B2 * | 9/2017 | Jeong | B29C 45/372 |
| 2005/0225492 | A1 | 10/2005 | Metz | |
| 2008/0165079 | A1 * | 7/2008 | Smith | H01Q 15/08 343/911 R |
| 2013/0135578 | A1 | 5/2013 | Pugh et al. | |
| 2014/0139370 | A1 * | 5/2014 | Hamner | H01Q 21/0031 342/175 |
| 2016/0027846 | A1 | 1/2016 | Lieber et al. | |
| 2016/0056757 | A1 | 2/2016 | Neuhausler | |
| 2016/0322703 | A1 * | 11/2016 | Jesme | B29C 64/106 |
| 2017/0062944 | A1 * | 3/2017 | Zimmerman | H01Q 1/246 |
| 2017/0279202 | A1 * | 9/2017 | Galla | H01Q 19/062 |
| 2017/0324171 | A1 * | 11/2017 | Shehan | H01Q 1/246 |
| 2018/0286379 | A1 * | 10/2018 | Norris | G10K 11/30 |
| 2019/0324347 | A1 * | 10/2019 | Cummer | G01N 29/0654 |
| 2020/0018874 | A1 * | 1/2020 | Chisum | H01Q 15/02 |
| 2021/0151894 | A1 * | 5/2021 | Xin | H01Q 15/10 |

OTHER PUBLICATIONS

M. Liang et al., "An X-Band Luneburg Lens Antenna Fabricated by Rapid Prototyping Technology," IEEE MTT-S International Microwave Symposium, Jun. 5, 2011.

* cited by examiner

HOLLOW LIGHT WEIGHT LENS STRUCTURE

CROSS REFERENCE

This application is the US National Phase to International Application No. PCT/US2018/037885, filed Jun. 15, 2018, which claims priority to U.S. Provisional Patent Application No. 62/521,098, filed Jun. 16, 2017, the specifications of which are incorporated herein in their entirety by reference.

FIELD OF THE INVENTION

The present invention relates to the design and fabrication of a hollow 3D lens structures, more specifically, the design and fabrication of a hollow light weight Luneburg lens structure using partially-metalized thin film, string, threads, fiber or wire-based metamaterial.

BACKGROUND OF THE INVENTION

The Luneburg lens is an attractive gradient index device for multiple beam tracking because of its high gain, broadband behavior, and ability to form multiple beams. Every point on the surface of a Luneburg lens is the focal point of a plane wave incidents from the opposite side. The permittivity distribution of a Luneburg Lens is given by:

$$\varepsilon_r = 2 - \left(\frac{r}{R}\right)^2,$$

where $\varepsilon_r$ is the permittivity, R is the radius of the lens and r is the distance from the location to the center of the lens. In current technologies, a 3 dimensional ("3D") printed Luneburg lens structure is constructed by controlling the filling ratio between the polymer composing the lens and air. Most of the lens structure is typically made of polymer; therefore, its weight increases significantly when the size of the lens becomes larger. Further, fabrication costs associated with current technologies are typically high for larger lens size. The present invention features a hollow light weight, low-cost, and high performance 3D Luneburg lens structure using partially-metallized thin film, string, threads, fiber or wire-based metamaterial.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a method for fabricating a hollow light-weight 3D lens structure operable in the RF frequency range. In some embodiments, partially-metalized thin film or wire is used to implement the continuously varying relative permittivity profile characteristic of the lens structures. In alternate embodiments, wire base dielectrics are utilized to implement the relative permittivity profile.

One of the unique and inventive technical features of the present invention is the use of the effective medium approach to increase the amount of free-space comprising the volume of the present 3D Luneburg lens structure, relative to conventional 3D Luneburg lenses. Without wishing to limit the invention to any theory or mechanism, it is believed that the technical feature of the present invention advantageously provides for a hollow lighter weighing lens structure and, as less material is required, a higher fabrication rate. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DETAILED DESCRIPTION OF THE INVENTION

Figure 1A:
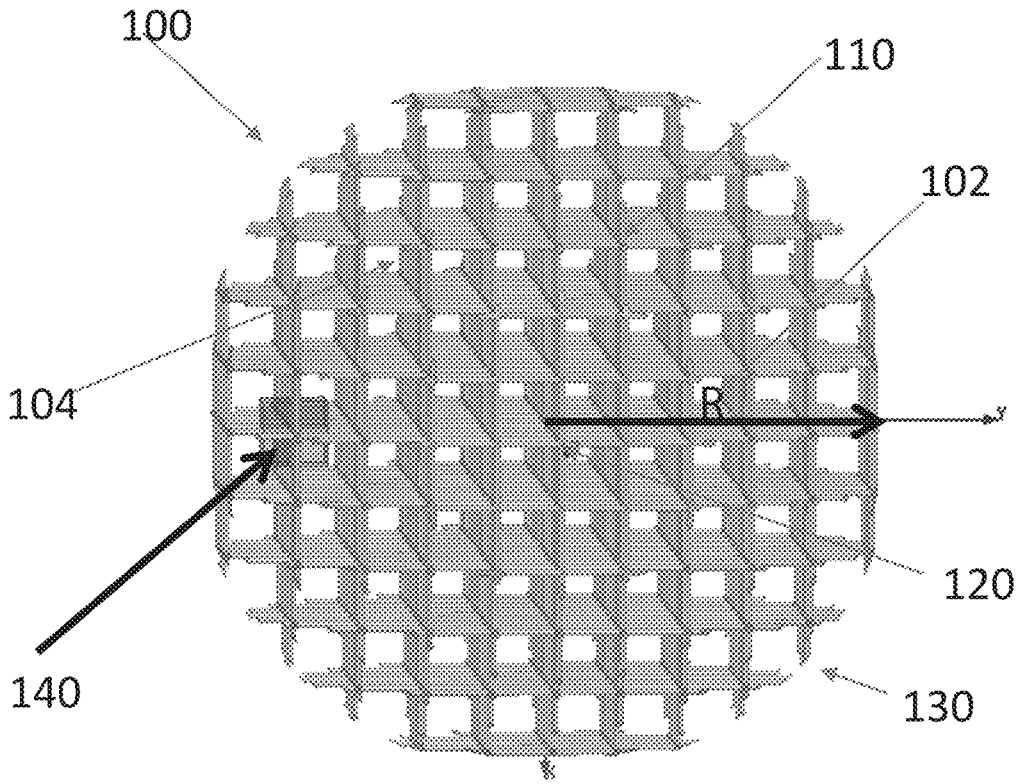
FIG. 1A is an illustration of the principal of the hollow structure lens.

In a broad embodiment, the present invention features a hollow structure lens (100) with radius R (102) comprising:

a) a three-dimensional scaffold (104) having multiple junctions (110); wherein each junction inside the lens is at least partially metalized (170), (180) to a degree;

b) a center point (120) of the hollow structure lens (100) formed by the three-dimensional scaffold (104); and c) an outer edge (130) of the hollow structure lens (100) formed by the three-dimensional scaffold (104);

wherein the three-dimensional scaffold (104) forms the junctions (110) inside the lens;

wherein the junctions (110) are positioned from the innermost of the lens at or near the center point (120) toward the outermost of the lens at or near the edge (130) of the lens (100);

wherein each junction (110) resides in an imaginary unit cell (140); each imaginary unit cell is at least partially metalized to the degree of the at least partially metalized junction (170) that resides within each imaginary unit cell (140);

wherein the further the partially metalized junction (180) is away from the center point (120), the less the degree of the metallization of the imaginary cell (140).

In some embodiments, the degree of the metallization of the imaginary cell can be calculated by a full-wave finite-element simulation software, to produce a permittivity of the imaginary cell being $\varepsilon_r$ wherein $$\varepsilon_r = 2 - \left(\frac{r}{R}\right)^2,$$

wherein r is the distance of the junction to the center point (120).

In some embodiments, the at least partially metalized junction is constructed from a at least partially metalized thin film (180), thread, fiber, wire or string (190).

In some embodiments, a metal etch, or an ink jet print can be used to metalize a metamaterial substrates to make the partially metallized junctions (180), (190).

In some embodiments, the scaffold (104) is constructed by stacking layers of the at least partially metalized thin films, wires, threads, fiber or strings in a way that each layer crisscross to each other to produce the hollow structure lens (100).

In some embodiments, the crisscross layers is fixed on to a support frame (200).

In some embodiments, the support frame is 3D printed.

In some embodiments, the scaffold and partially metalized junctions is constructed by interlocking at least partially metalized thin film plates (210), (220); wherein interlocking means at least 2 plates intersect with each other and form the junction (110); wherein the at least partially metalized plates form at least partially metalized junctions when they interlock.

In some embodiments, most of the space is a free space due to 3D scaffold structure.

In some embodiments, the hollow structure lens (100) is a Luneburg lens.

In a broad embodiment, the present invention features a method for fabricating a hollow light-weight lens structure, operating in Radio Frequency (RF), by utilizing effective medium approximations of partially-metalized metamaterial thin film, wire, threads, fiber or string, the method comprising a) etching a series of patterns, descriptive of a continuously varying relative permittivity characteristic of the light-weight lens structure, on a series of layers of a dielectric substrate with conductive ink;

b) providing a support frame;

c) assembling the light-weight lens structure by stacking the series of layers of the dielectric substrate; and d) securing said stacking with the set of support frames.

In a broad embodiment, the present invention features the lens is a Luneburg lens.

In a broad embodiment, the present invention features a hollow light-weight lens structure, operating in RF frequency, by utilizing effective medium approximations of partially-metalized dielectric thin film, wire, string, threads or fiber to realize a gradient index requirement of Luneburg lens structures, the method comprising constructing a set of design patterns, representative of a continuously varying relative permittivity characteristic of the light-weight Luneburg lens structure, with a plurality of partially-metallized strings, wherein each partially-metallized string comprises a metallic coating disposed on a metamaterial.

Referring now to FIGS. 1A-11, the present invention features a method for fabricating a hollow light-weight Luneburg lens structure operable in the RF frequency range. The light weight of the lens structure, (relative to conventional Luneburg lens structures), is accomplished by utilizing effective medium approximations of partially-metalized dielectric thin film, wire or string to increase an amount of free-space comprising the volume of the light-weight Luneburg lens structure. In some embodiments, the method comprises etching a series of patterns, descriptive of a continuously varying relative permittivity characteristic of the light-weight Luneburg lens structure, onto a series of layers of a dielectric substrate with conductive ink. In further embodiments, a set of support frames, composed of polymer, are printed via a 3-D printer. The light-weight Luneburg lens structure may be assembled by stacking the series of layers of the dielectric substrate, and securing said stacking with the set of support frames.

A conventional 3D printed Luneburg lens structure having the same dimensions of the present light-weight Luneburg lens structure has a weight of 500 g, while the weight of the light-weight Luneburg lens structure is less than 20 g (excluding the set of supporting frames). Moreover, the majority of the weight of the light-weight Luneburg lens structure is a result of the weight of the set of supporting frames, which is about 180 g. By replacing the frames with other lighter materials (e.g., foam), the weight of the light-weight Luneburg lens structure may be further decreased.

In an alternate embodiment, the continuously varying relative permittivity characteristic of the light-weight Luneburg lens structure is realized by employing a plurality of partially-metallized strings. Each partially-metallized string may comprise a metallic coating disposed on a dielectric substrate. Examples of methods for coating the dielectric substrate with the metallic portion include, but are not limited to: conductive ink printing, copper painting, and electronic platting.

Figure 1B:
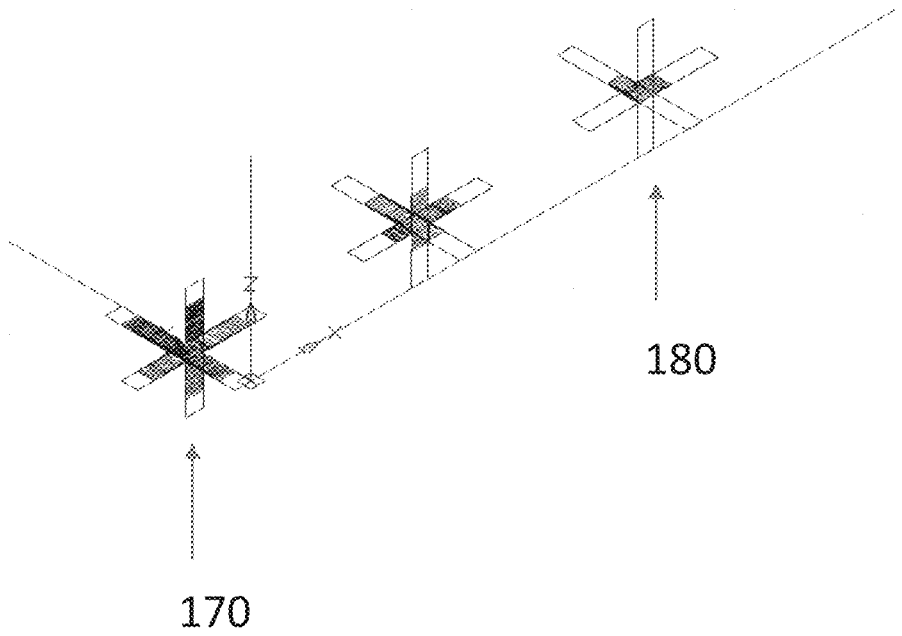
FIG. 1B is an illustration of metallization of imaginary cell and the degree of metallization according to its junction location.
Figure 1C:
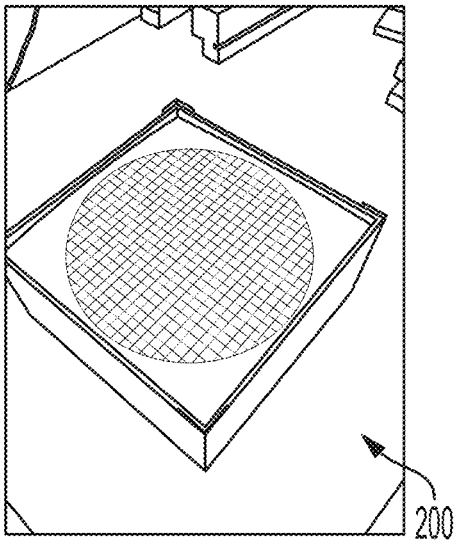
FIG. 1C is a photo of a center cross-section of a hollow light-weight Luneburg lens structure.
Figure 1D:
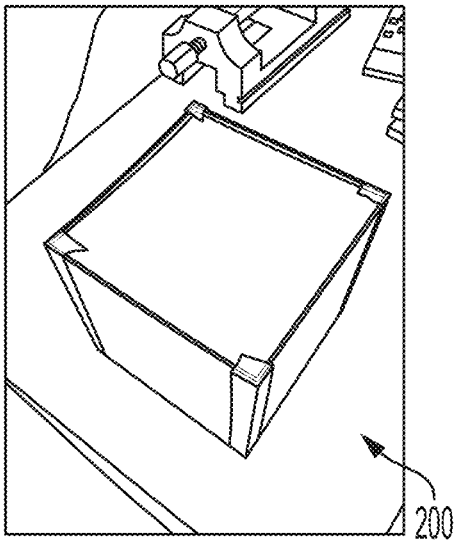
FIG. 1D is a photo of the hollow light-weight Luneburg lens structure of the present invention.
Figure 2A:
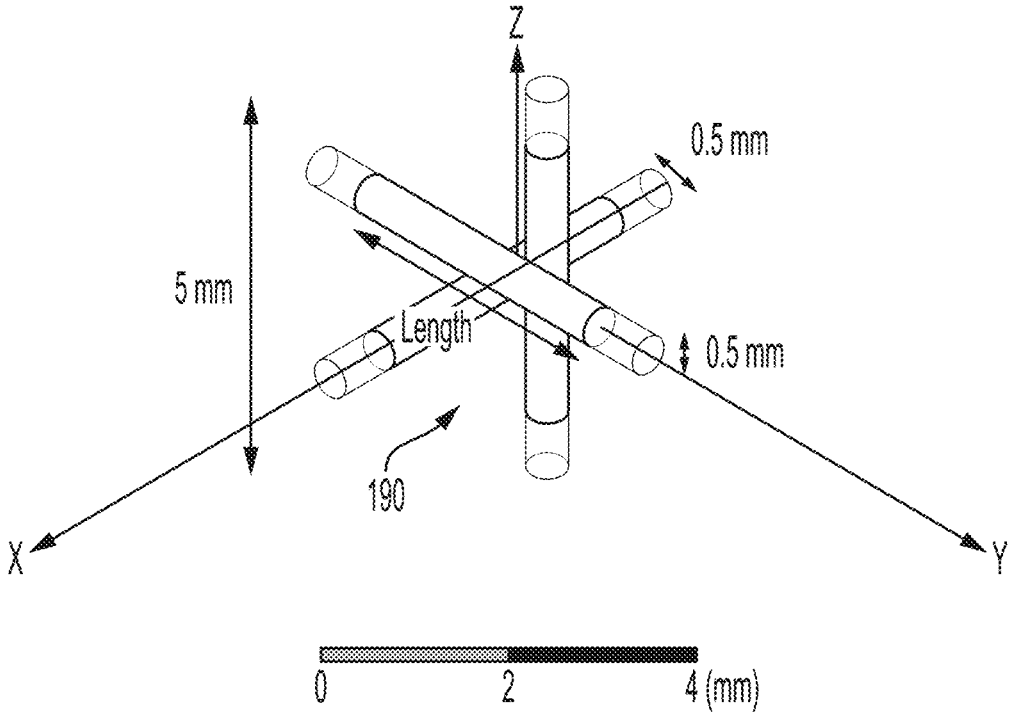
FIG. 2A shows an illustration of the unit cell structure of the partially-metallized wire-based hollow light-weight Luneburg lens structure having a unit cell size of 5 mm.
Figure 2B:
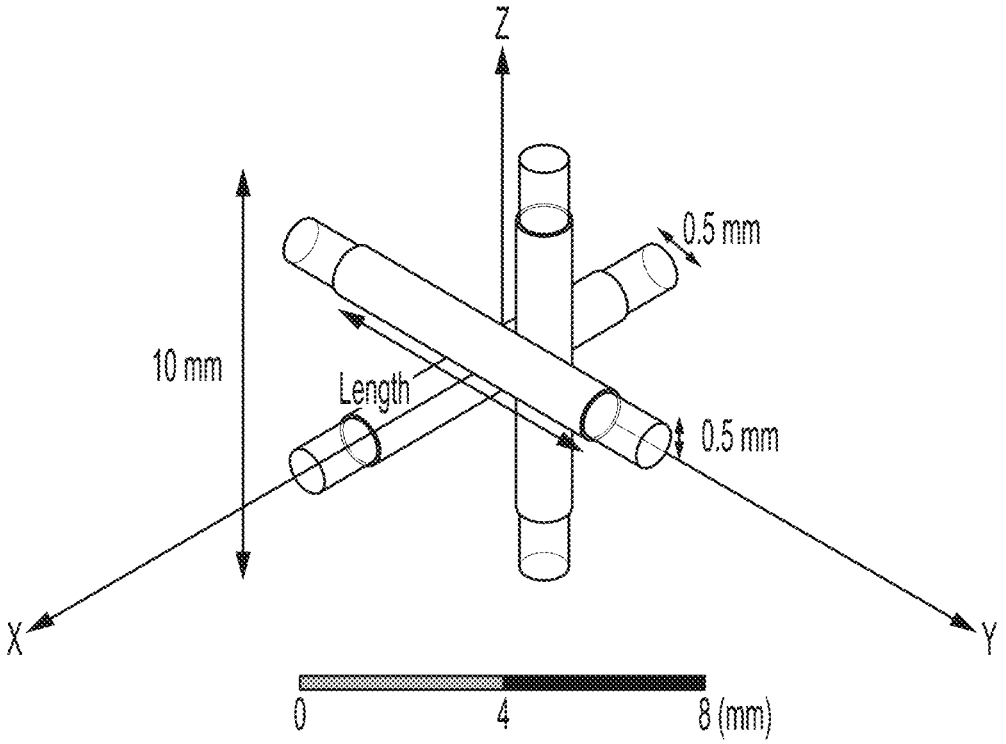
FIG. 2B shows an illustration of the unit cell structure of the partially-metallized string-based hollow light-weight Luneburg lens structure having a unit cell size of 10 mm. The dielectric wire, having a copper coating, has a diameter of 0.5 mm and a dielectric constant of 2.8. Metal traces include all three axes (X, Y, and Z).
Figure 2C:
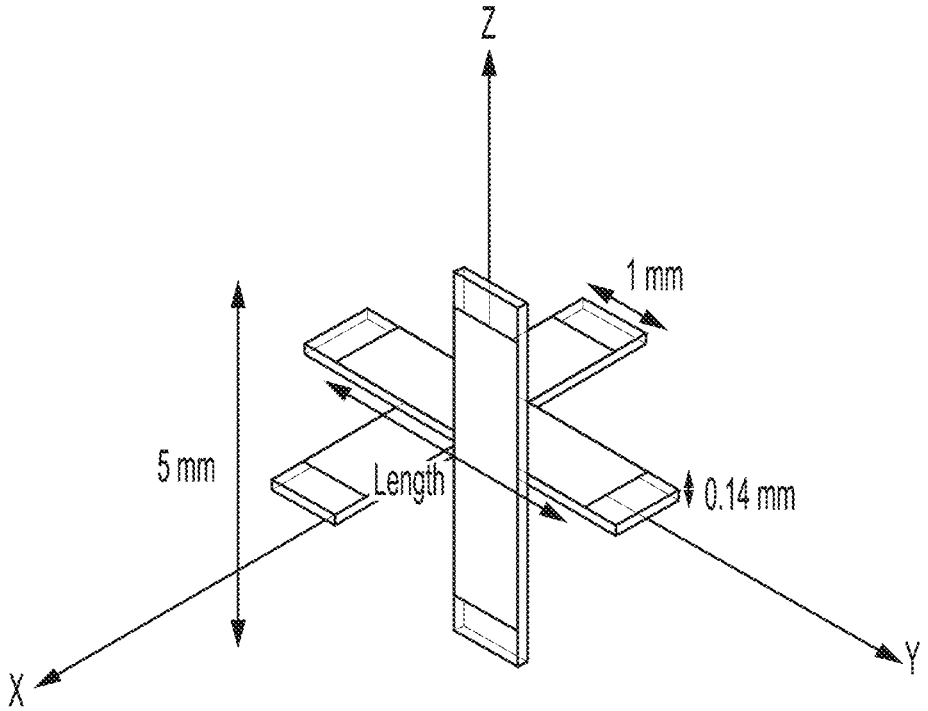
FIG. 2C shows an illustration of an alternate embodiment of the unit cell structure of the partially-metallized string-based hollow light-weight Luneburg lens structure having a unit cell size of 5 mm. The dielectric wire has a thickness of 0.14 mm and a permittivity 2.5. The metal traces have a conductivity of $1\times10^{-5}$ S/m to emulate the conductive ink before sintering. Metal traces including all three axes (X, Y, and Z).
Figure 3A:
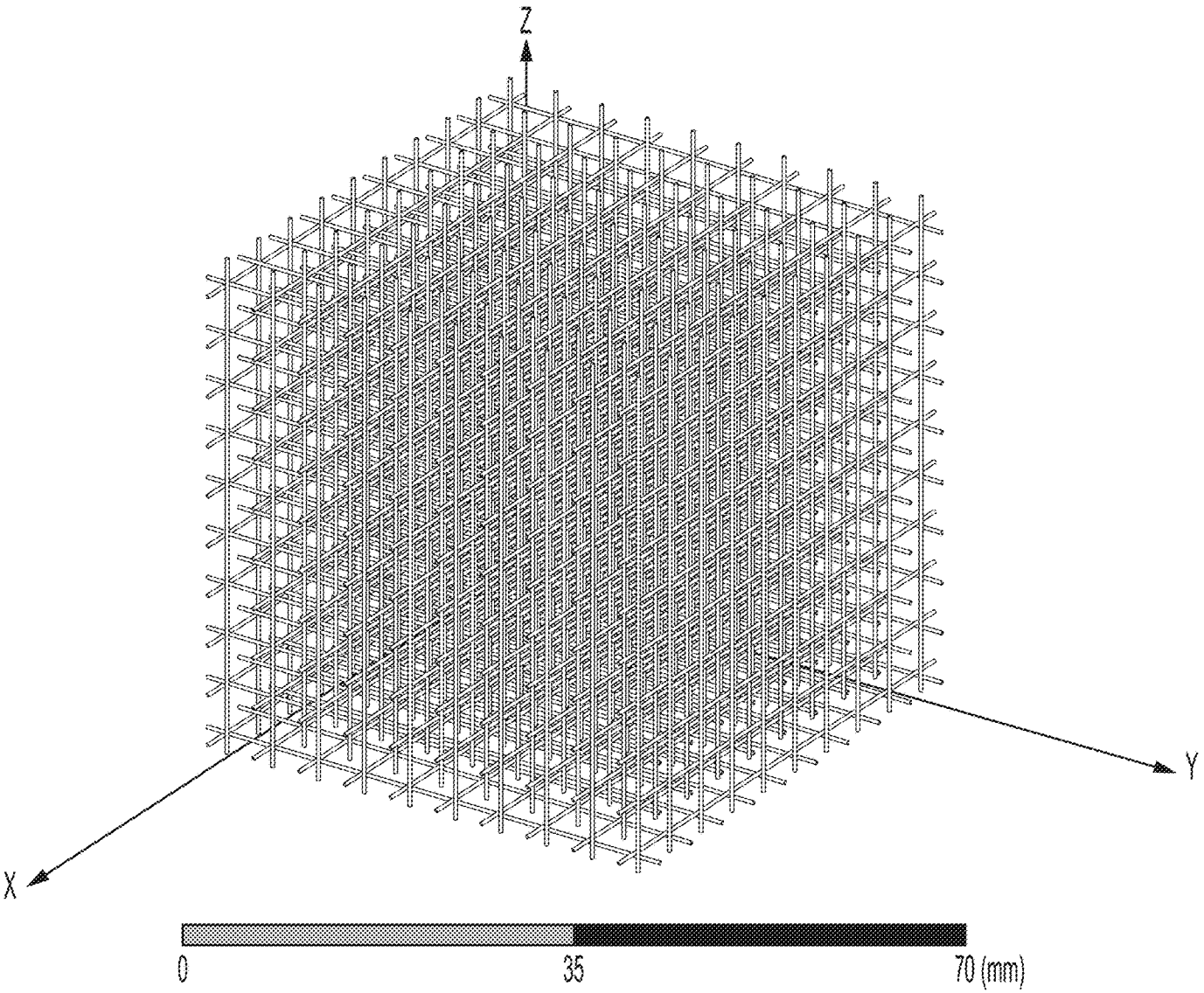
FIG. 3A shows an example of a 25-layer partially-metallized string-based hollow light-weight Luneburg lens structure having a plurality of unit cell structures, each as detailed in FIG. 2A.
Figure 3B:
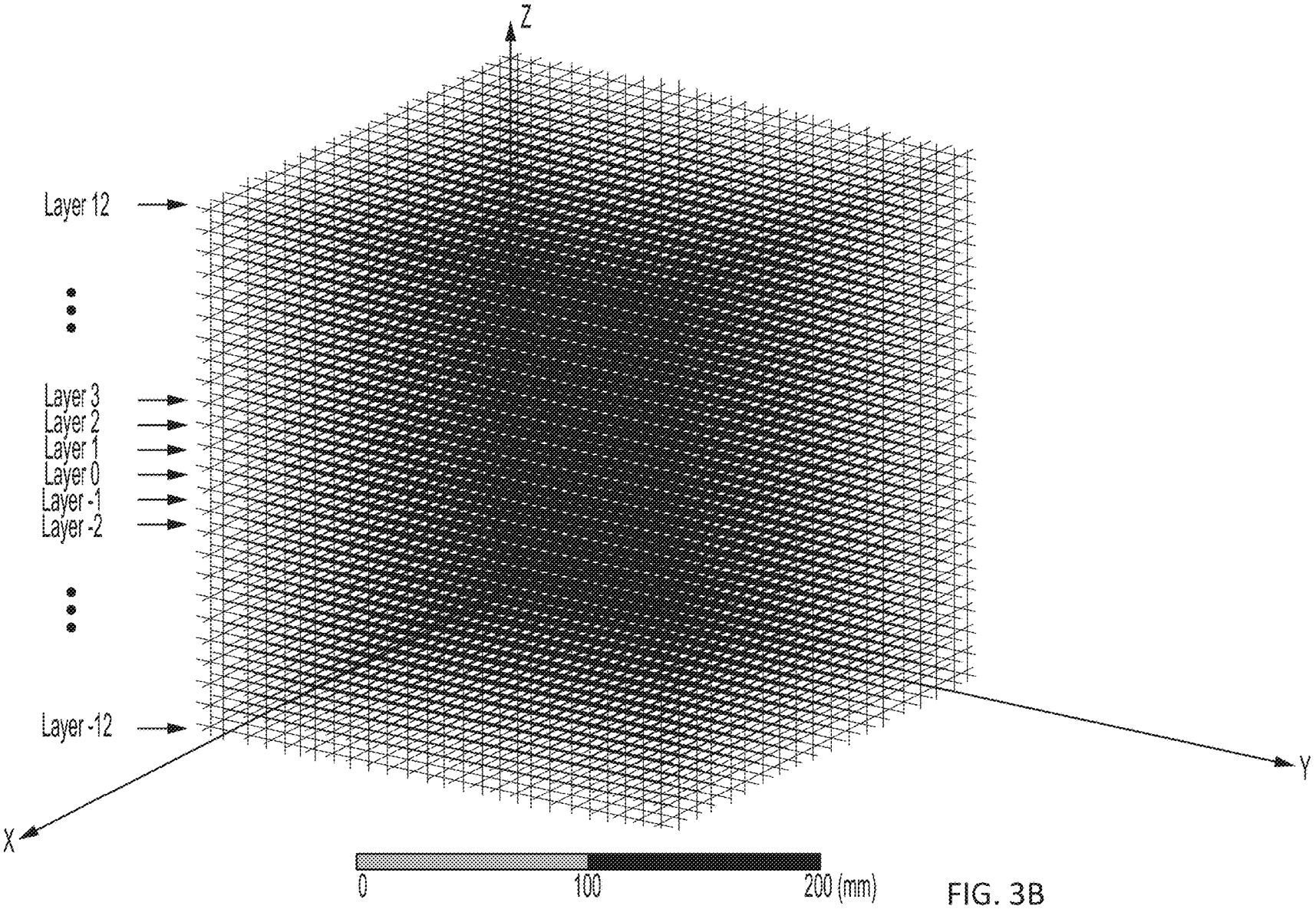
FIG. 3B shows an example of a 25-layer partially-metallized string-based hollow light-weight Luneburg lens structure having a plurality of unit cell structures, each as detailed in FIG. 2B.
Figure 3C:
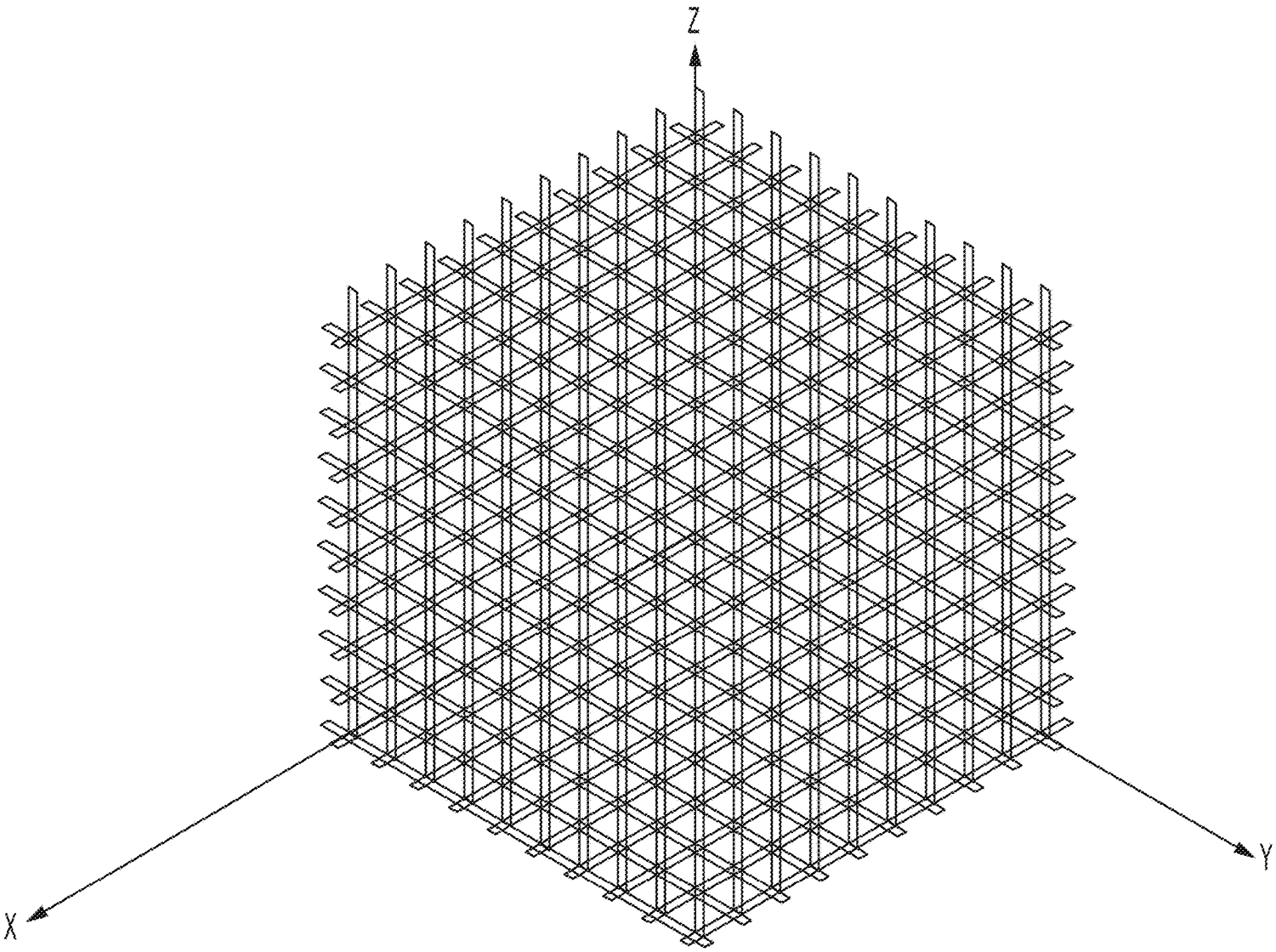
FIG. 3C shows an example of a 25-layer partially-metallized string-based hollow light-weight Luneburg lens structure having a plurality of unit cell structures, each as detailed in FIG. 2C.
Figure 4:
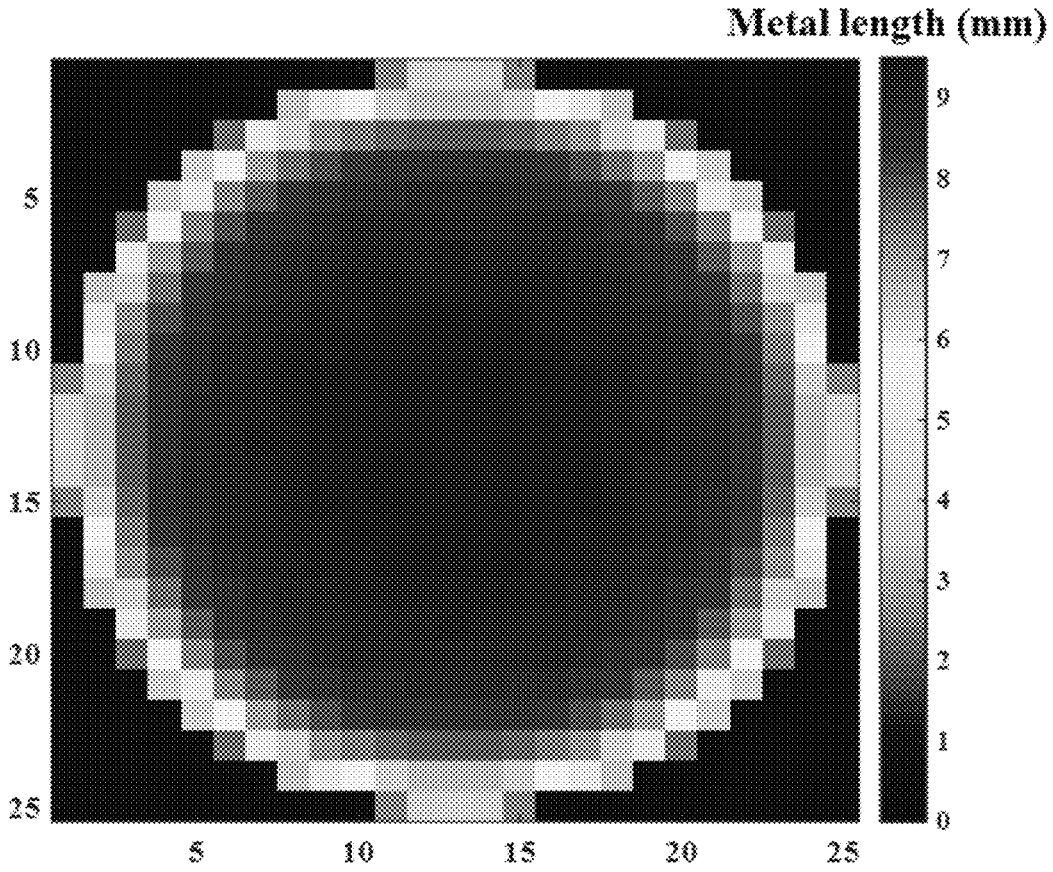
FIG. 4 shows an example of the metal length distribution for layer 0 of the unit cell of FIG. 2B.
Figure 5A:
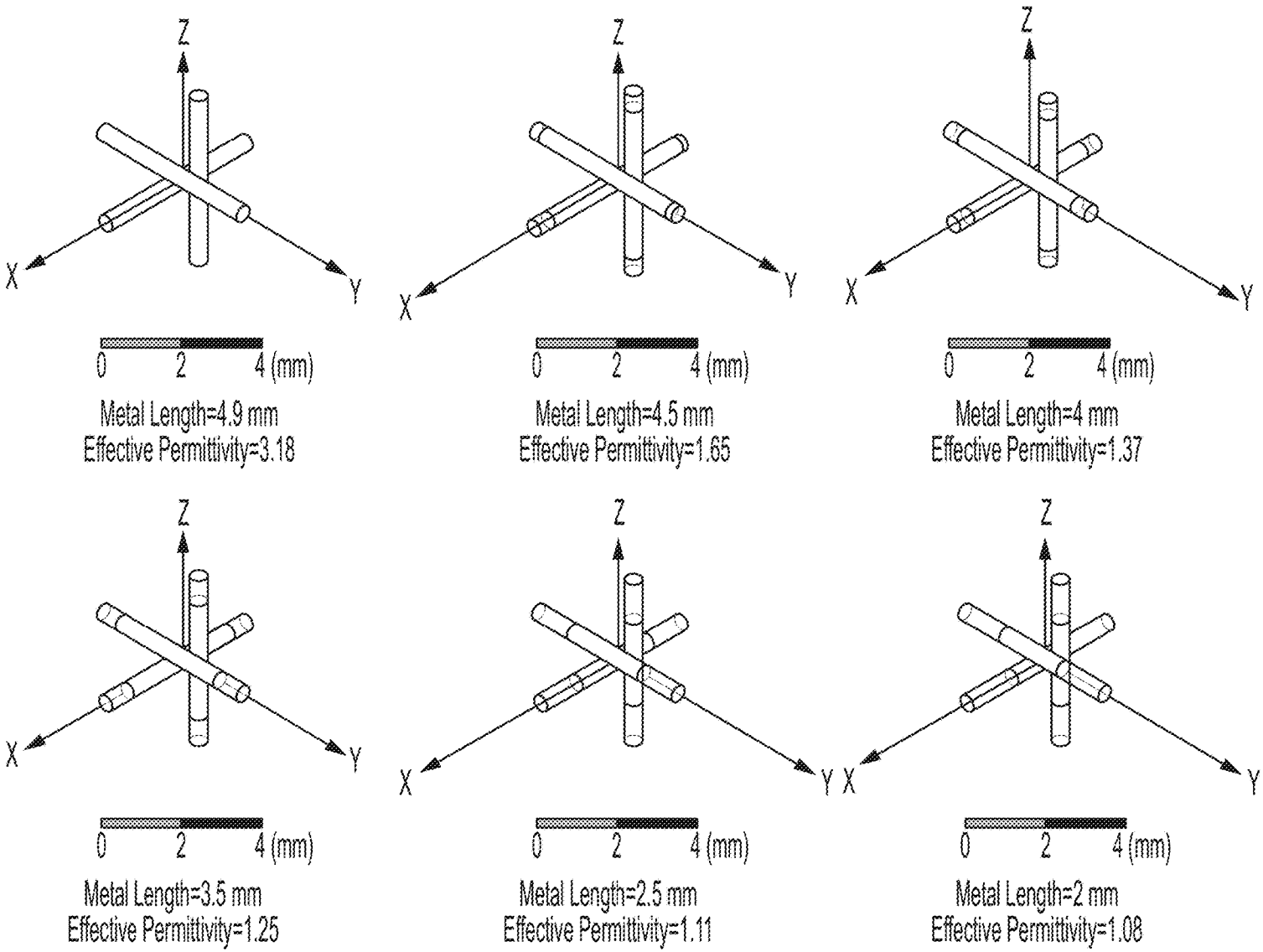
FIG. 5A shows unit cell simulations and effective permittivity for the unit cell structure of FIG. 2A.
Figure 5B:
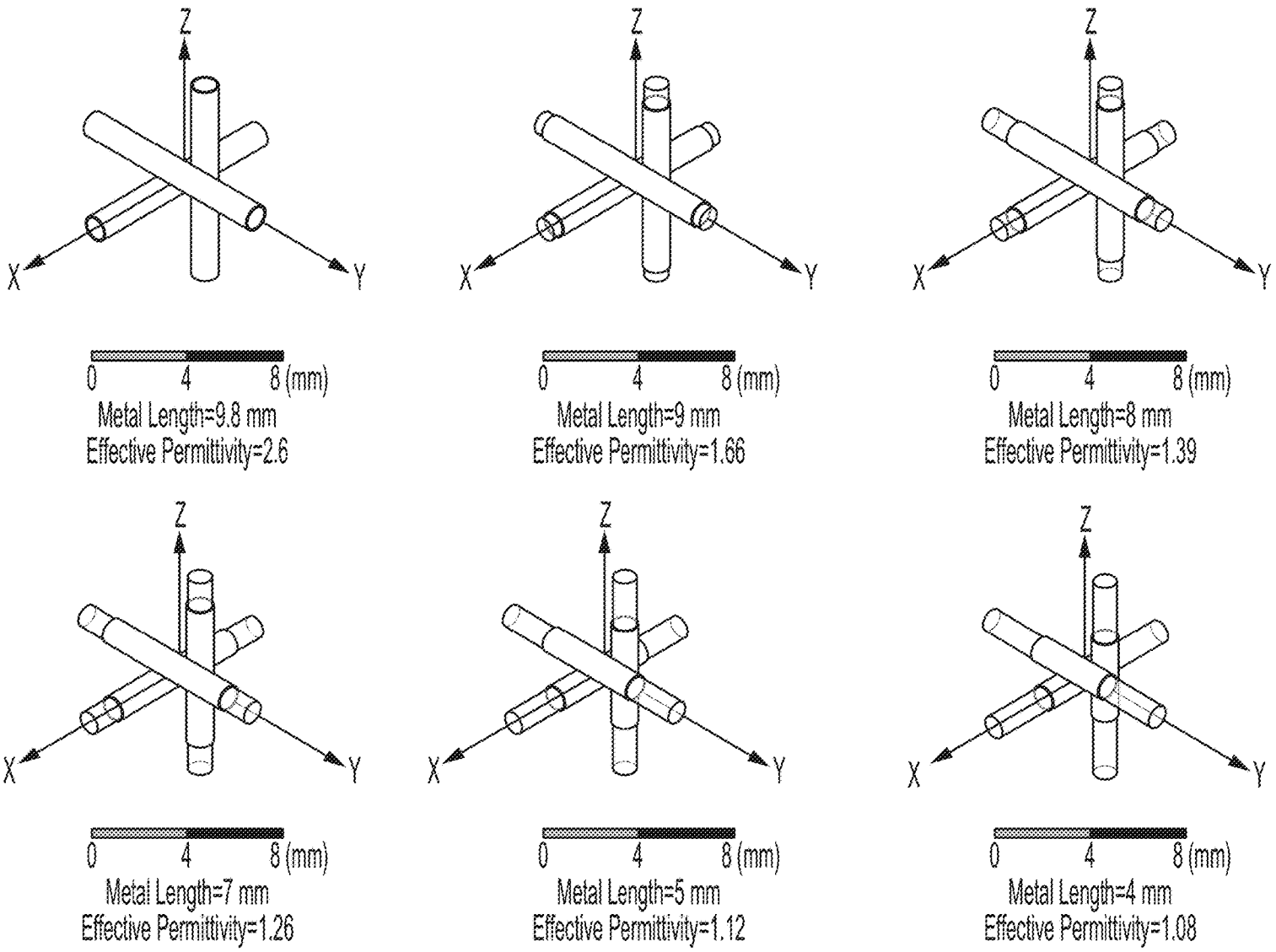
FIG. 5B shows unit cell simulations and effective permittivity for the unit cell structure of FIG. 2B.
Figure 5C:
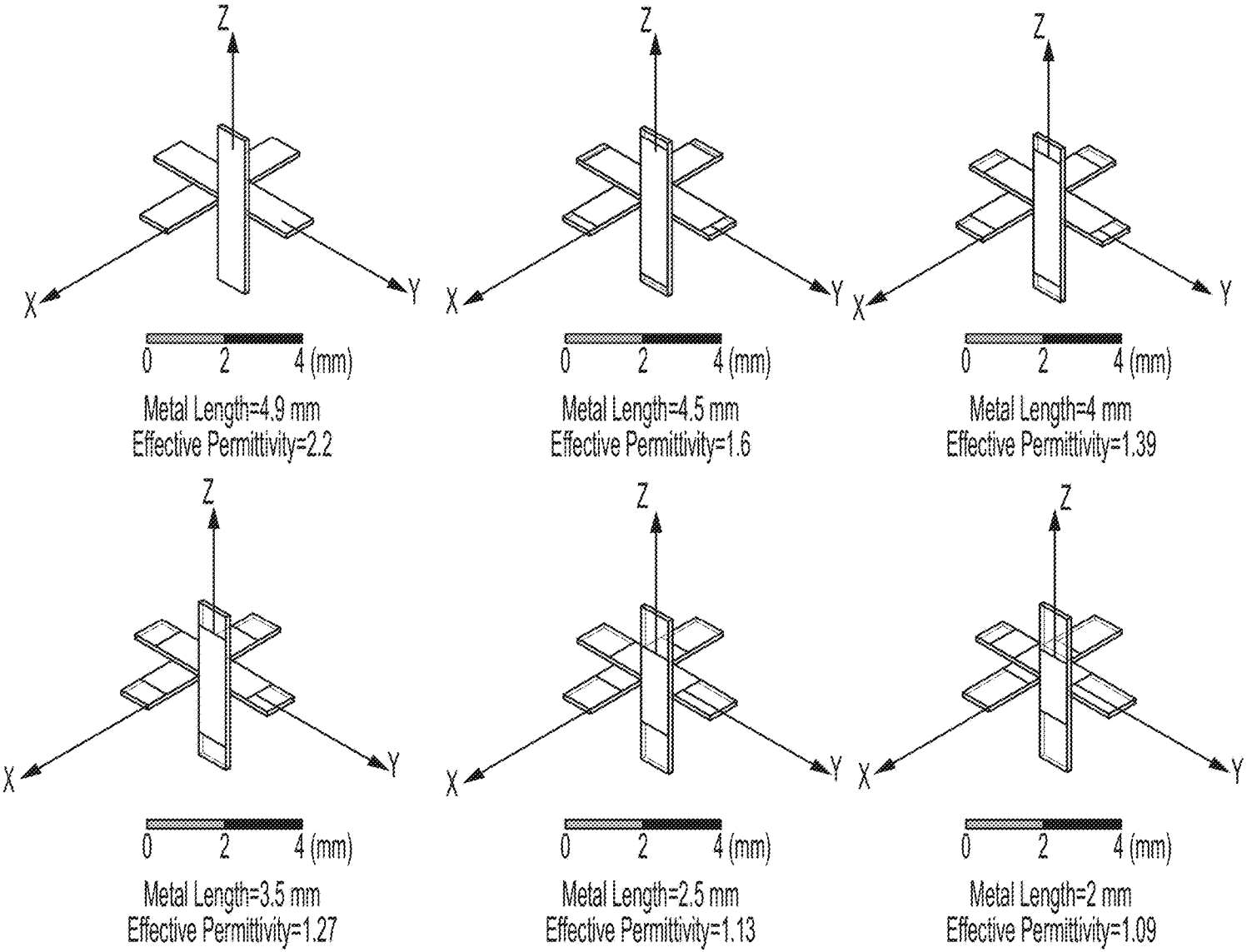
FIG. 5C shows unit cell simulations and effective permittivity for the unit cell structure of FIG. 2C.
Figure 6A:
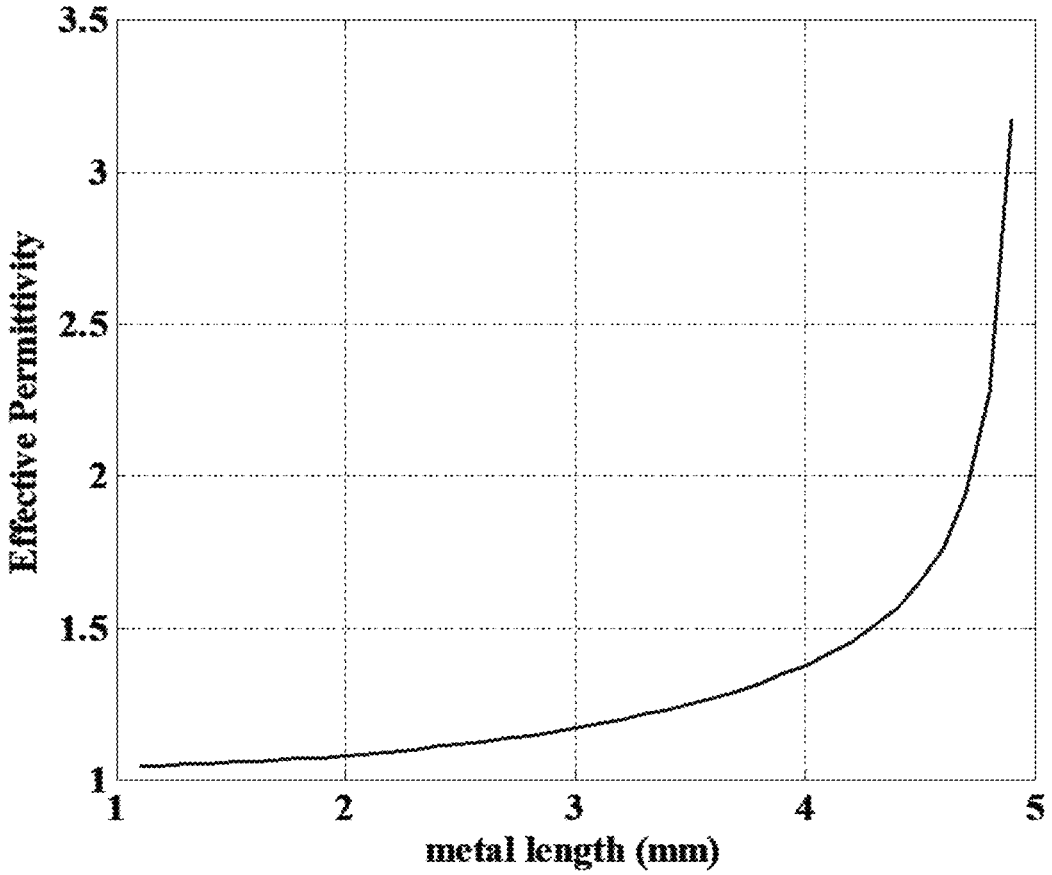
FIG. 6A shows a graph of the simulated relationship between metal length and effective permittivity as detailed in FIG. 5A.
Figure 6B:
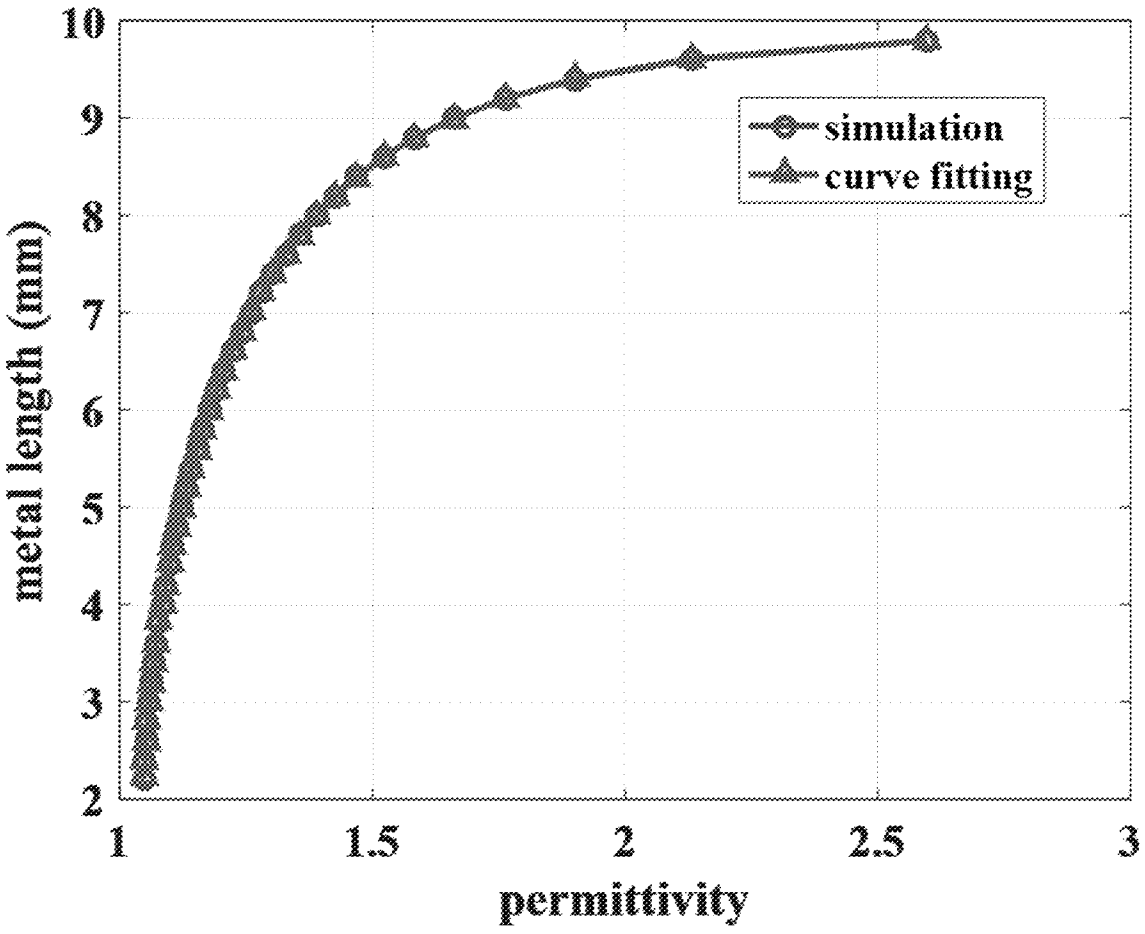
FIG. 6B shows a graph of the simulated relationship between metal length and effective permittivity as detailed in FIG. 5B.
Figure 6C:
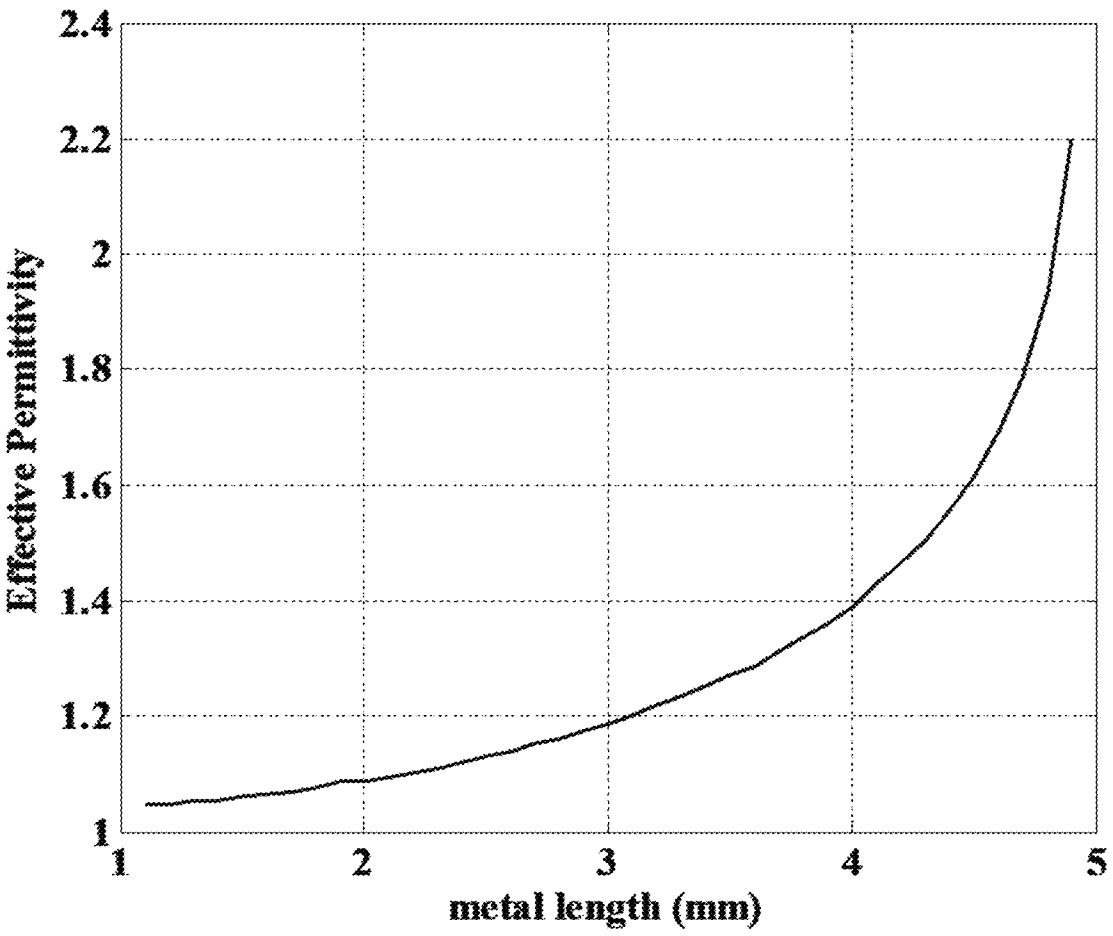
FIG. 6C shows a graph of the simulated relationship between metal length and effective permittivity as detailed in FIG. 5C.
Figure 7:
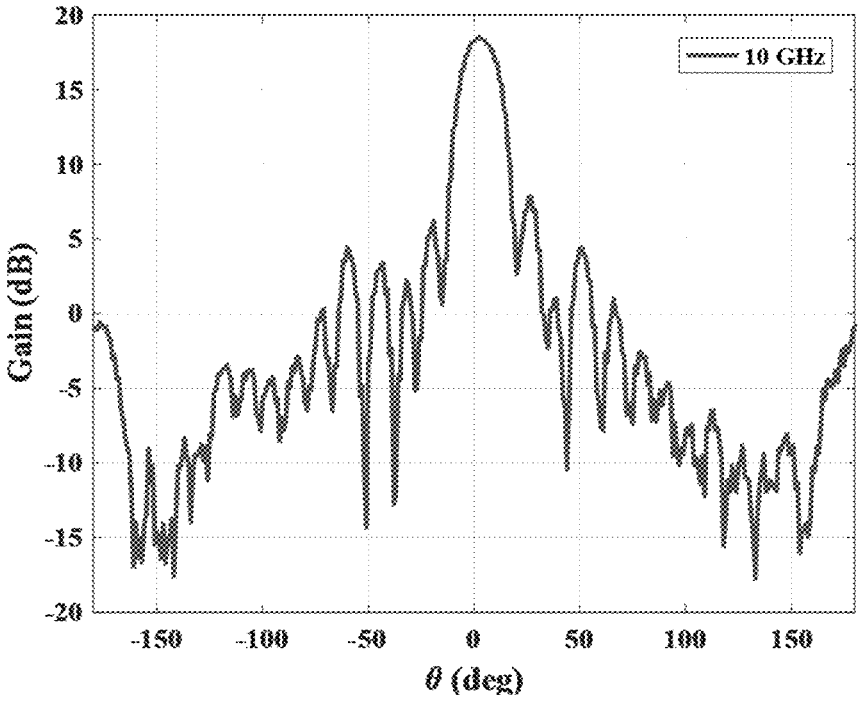
FIG. 7 shows the measured the plane containing the magnetic field vector ("H-plane") radiation pattern of the light-weight Luneburg lens of FIG. 1B.
Figure 8:
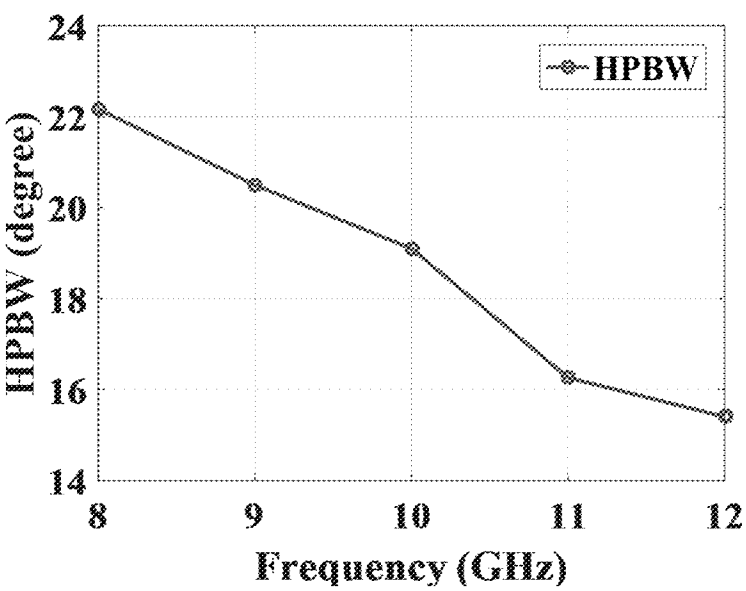
FIG. 8 shows the gain and H-plane half-power beamwidth ("HPBW") at different frequencies from 8 to 12 GHz of the light-weight Luneburg lens of FIG. 1B.
Figure 8:
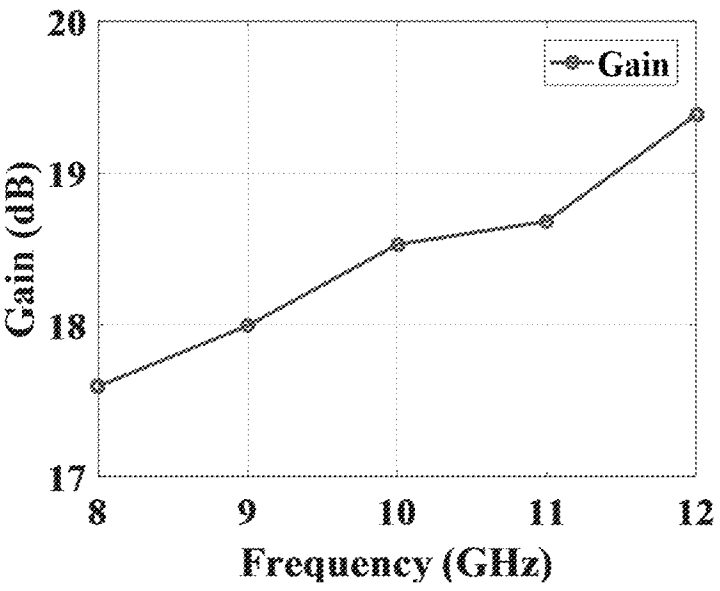

FIGS. 2A-2C show an example of a unit cell structure of various sizes for the partially-metallized string or thin film based hollow light-weight Luneburg lens structure. The effective permittivity of the unit cell was simulated by full-wave finite-element simulation software ANSYS HFSS. Darker portions represent the metallized coating and lighter portions represent the dielectric. FIG. 4 illustrates the metal length distribution for layer 0 of the unit cell of FIG. 2B. The lens is symmetric. Therefore, the distribution for layer 1 and layer −1 is the same, as is the distribution for layer 2 and layer −2, and so on. FIG. 7 shows the measured H-plane radiation of the light-weight Luneburg lens of FIG. 1B. The measured gain at 10 GHz is 18.5 dB. The measured gain at 10 GHz is 0.5 dB lower than the 3D printed Luneburg lens of FIG. 1D. The side lobe is 5 dB higher than the 3D printed Luneburg lens. The lower gain and higher side lobe may be due to the outside frame used to mount the lens.

Figure 9:
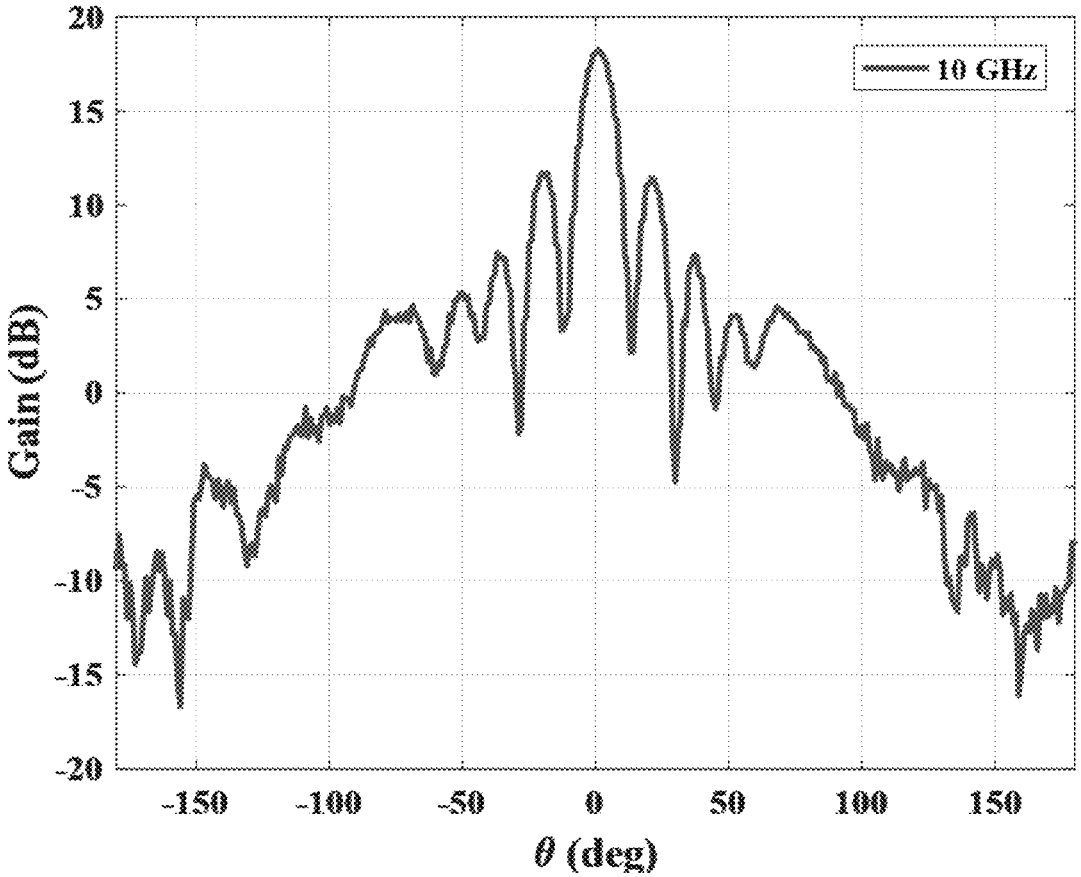
FIG. 9 shows the measured plane containing the electric field vector ("E-plane") radiation pattern of the light-weight Luneburg lens of FIG. 1B.
Figure 10:
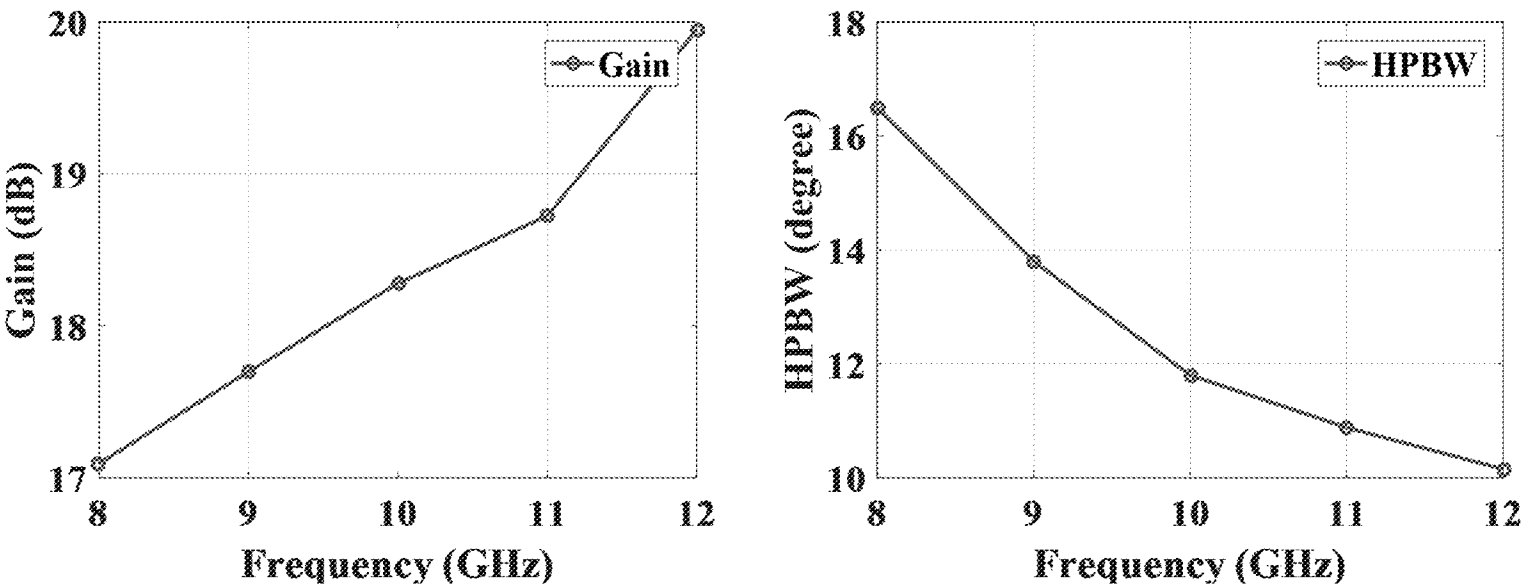
FIG. 10 shows the gain and E-plane HPBW at different frequencies from 8 to 12 GHz of the light-weight Luneburg lens of FIG. 1B.
Figure 11:
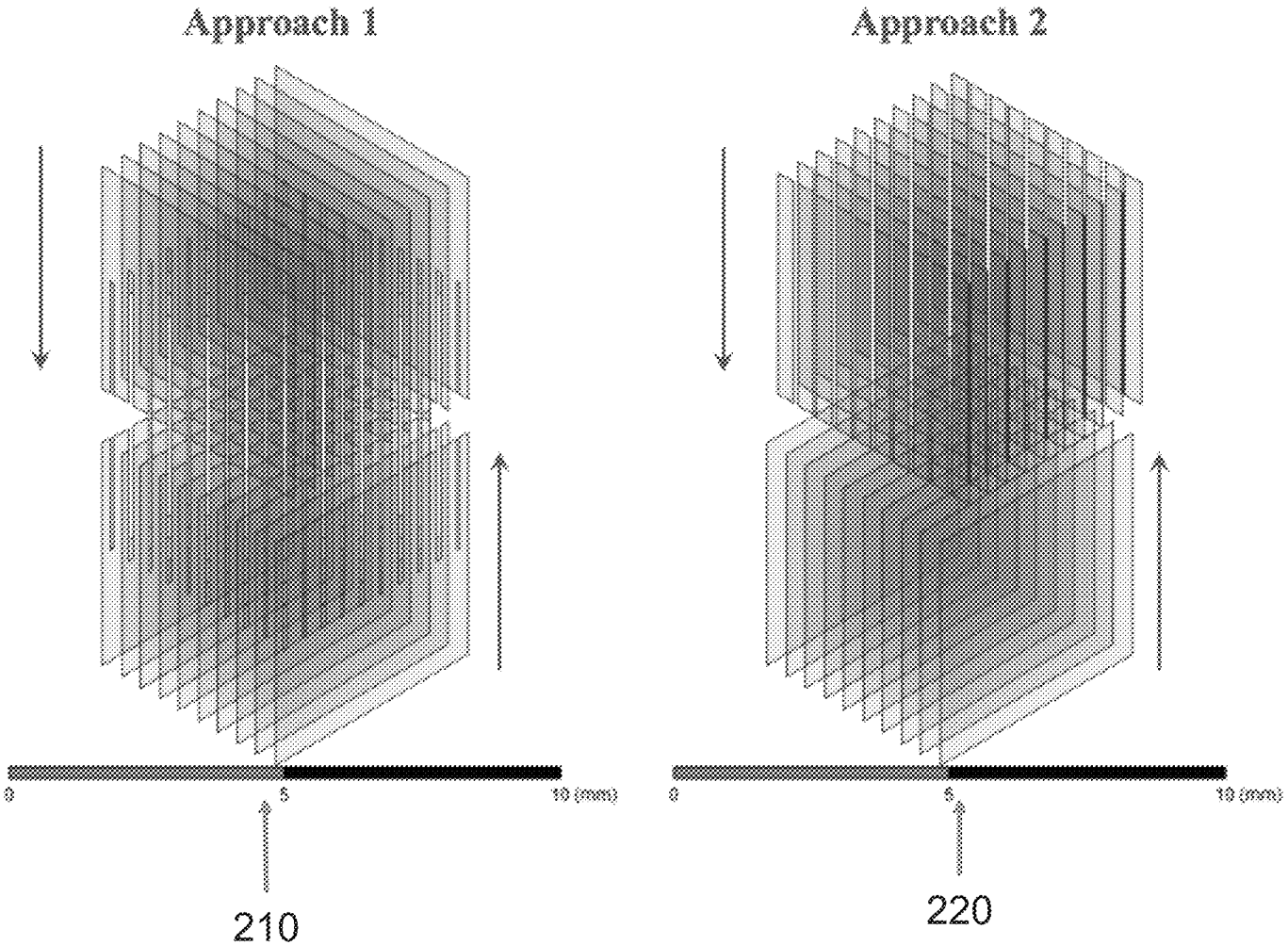
FIG. 11 shows two additional approaches to constructing the partially-metallized plate-based hollow light-weight Luneburg lens structure.

FIG. 9 shows the measured H-plane radiation of the light-weight Luneburg lens of FIG. 1B. The measured gain at 10 GHz is 18.3 dB. The side lobe in E-plane is even higher than the side lobe in H-plane, especially at 12 GHz. Removal of the frame may result in further improvement.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be clear to those skilled in the art that modifications may be made thereto which do not exceed the scope of the appended claims. Therefore, the scope of the invention is only to be limited by the following claims. Reference numbers recited in the claims are exemplary and for ease of review by the patent office only and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hollow structure 3D Luneburg lens comprising:

a three-dimensional scaffold having multiple junctions, wherein each of the junctions is at least partially metalized, wherein a center point of the hollow structure lens is formed by the three-dimensional scaffold, wherein the junctions are positioned from an innermost position of the lens at or near the center point toward an outermost position of the lens at or near an edge of the lens, wherein each of the junctions resides in an imaginary unit cell, respectively, and the imaginary unit cell is at least partially metalized with a degree of metallization of at least that of the partially metalized junction that resides within the imaginary unit cell, and wherein a further the partially metalized junction is away from the center point, a less the degree of metallization of the imaginary unit cell.

2. The Luneburg lens of claim 1, wherein the degree of metallization of the imaginary unit cell is calculated by a full-wave finite-element simulation software, to produce a permittivity of the imaginary unit cell being $\varepsilon_r$, wherein $$\varepsilon_r = 2 - \left(\frac{r}{R}\right)^2,$$

wherein r is the distance of the junction to the center point.

3. The Luneburg lens of claim 1, wherein the lens is adapted for RF frequency.

4. The Luneburg lens of claim 1, wherein the lens comprises a support frame that is 3D printed.

5. The Luneburg lens of claim 1, wherein the lens has a weight of 20 grams or less excluding a support frame.

6. The Luneburg lens of claim 1, wherein the at least partially metalized junction is constructed from at least a partially metalized thin film, thread, fiber, wire, or string.

7. The Luneburg lens of claim 1, wherein the scaffold is constructed by stacking layers of at least partially metalized thin films, wires, or strings such that each layer crisscrosses each other to produce the hollow structure lens.

8. The Luneburg lens of claim 7, wherein the crisscross layers are fixed to a support frame.

9. The Luneburg lens of claim 1, further comprising a support frame that is 3D printed.

10. The Luneburg lens of claim 1 wherein the partially metalized junction is interlocked with at least partially metalized thin film plates.

11. The Luneburg lens of claim 10, wherein at least two of the thin film plates intersect with each other and form the junction.

12. The Luneburg lens of claim 10, wherein the at least partially metalized thin film plates form the at least partially metalized junctions when interlocked.

13. The Luneburg lens of claim 1, wherein a majority of space in the hollow structure lens is free space due to the 3D scaffold.

* * * * *